US011677195B2

(12) United States Patent
Park et al.

(10) Patent No.: US 11,677,195 B2
(45) Date of Patent: Jun. 13, 2023

(54) COAXIAL CONNECTOR

(71) Applicant: KMW INC., Hwaseong-si (KR)

(72) Inventors: Nam Shin Park, Hwaseong-si (KR); Joung Hoe Kim, Hwaseong-si (KR); Jin Hoon Lim, Suwon-si (KR); Min Hee Lee, Yongin-si (KR); Ho Jin Hwang, Suwon-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 17/549,912

(22) Filed: Dec. 14, 2021

(65) Prior Publication Data

US 2022/0109273 A1 Apr. 7, 2022

Related U.S. Application Data

(63) Continuation of application No. 16/846,247, filed on Apr. 10, 2020, now Pat. No. 11,239,616, which is a (Continued)

(30) Foreign Application Priority Data

Oct. 13, 2017 (KR) ..... 10-2017-0133609

(51) Int. Cl.
*H01R 12/91* (2011.01)
*H01R 24/50* (2011.01)

(Continued)

(52) U.S. Cl.
CPC ..... *H01R 24/50* (2013.01); *H01R 13/6588* (2013.01); *H01R 2103/00* (2013.01)

(58) Field of Classification Search
CPC ..... H01R 24/50; H01R 13/6588; H01R 2103/00; H01R 13/2421; H01R 12/73;

(Continued)

(56) References Cited

U.S. PATENT DOCUMENTS 6,699,054 B1 3/2004 Critelli
7,922,529 B1 * 4/2011 Meurer ..... H01R 13/2421 439/700

(Continued)

FOREIGN PATENT DOCUMENTS

CN 201450195 U 5/2010
EP 2367239 A1 9/2011

(Continued)

OTHER PUBLICATIONS

International Search Report for PCT/KR2018/012004, dated Feb. 18, 2019, and its English translation.

(Continued)

*Primary Examiner* — Abdullah A Riyami
*Assistant Examiner* — Nelson R. Burgos-Guntin
(74) *Attorney, Agent, or Firm* — Insight Law Group, PLLC; Seung Lee

(57) ABSTRACT

The present disclosure relates to a coaxial connector, and particularly, a coaxial connector including a fixing module which is connected to a first PCB, and a contact module which is coupled movably to the fixing module, and provided to be contactable to a second PCB facing the first panel, in which the contact module includes a contact body which is made of a conductive material, and has a hollow formed therein, a contact pin which is made of a conductive material, and disposed to penetrate the hollow of the contact body, and a contact insulator which is disposed in the hollow of the contact body to insulate the contact pin and the contact body by partitioning the contact pin and the contact body, and the contact module is configured so that the contact body, the contact pin, and the contact insulator are integrally formed to be assembled to the fixing module by a singular process, thereby providing the advantages which may (Continued)

reduce the cost of a product, and improve the quality of the product by improving a contact rate.

12 Claims, 7 Drawing Sheets

Related U.S. Application Data continuation of application No. PCT/KR2018/012004, filed on Oct. 12, 2018.

(51) Int. Cl.
*H01R 13/6588* (2011.01)
*H01R 103/00* (2006.01)

(58) Field of Classification Search
CPC .. H01R 12/91; H01R 12/714; H01R 13/6582; H01R 24/38
See application file for complete search history.

(56) References Cited

U.S. PATENT DOCUMENTS

| | | | | |
|---|---|---|---|---|
| 9,559,441 | B2 * | 1/2017 | Pari | H01R 9/18 |
| 9,735,531 | B2 * | 8/2017 | Zhu | H01R 12/737 |
| 9,793,660 | B2 * | 10/2017 | Holland | H01R 24/46 |
| 10,103,485 | B2 * | 10/2018 | Ikeda | H01R 13/631 |
| 10,622,765 | B2 * | 4/2020 | Song | H01R 13/17 |
| 10,804,635 | B2 * | 10/2020 | Song | H01R 13/2407 |
| 2002/0061670 | A1 * | 5/2002 | Havener | H01R 24/50 439/246 |
| 2008/0057782 | A1 * | 3/2008 | Berthet | H01R 12/91 439/581 |

FOREIGN PATENT DOCUMENTS

| | | | |
|---|---|---|---|
| JP | 2004-273236 | A | 9/2004 |
| KR | 10-2008-0088145 | A | 10/2008 |
| KR | 10-2009-0048012 | A | 5/2009 |
| WO | 2013/129808 | A1 | 9/2013 |

OTHER PUBLICATIONS

Non-Final office action dated May 26, 2021 for U.S. Appl. No. 16/846,247.
Notice of Allowance dated Sep. 29, 2021 for U.S. Appl. No. 16/846,247.
Notice of Allowance dated Oct. 21, 2021 for U.S. Appl. No. 16/846,247.
Extended European Search Report dated May 19, 2021 for European Application No. 18866450.2.

* cited by examiner

COAXIAL CONNECTOR

CROSS-REFERENCE TO RELATED APPLICATIONS

This application is a Continuation of U.S. application Ser. No. 16/846,247, filed Apr. 10, 2020 (now pending), which is a Continuation of International Application No. PCT/KR2018/012004, filed on Oct. 12, 2018, which claims the benefit of and priority to Korean Patent Application No. 10-2017-0133609, filed on Oct. 13, 2017, the content of which are herein incorporated by reference in their entirety.

TECHNICAL FIELD

The present disclosure relates to a coaxial connector, and more particularly, to a coaxial connector, which may simplify a structure, thereby reducing costs, and minimize signal deficiency, thereby improving product quality.

BACKGROUND ART

Generally, a connector for Radio Frequency (RF) communication has various structures which may easily and densely connect a coaxial cable to a terminal. Such a connector for RF communication is largely used for being fastened to a terminal prepared in an enclosure which is easily confirmed with the naked eye, and when the connector and the terminal are prepared on each of two boards, the positions of the connector and the terminal are not accurately confirmed with the naked eye by the board thereof, thereby inevitably taking more time to connect them.

Particularly, since it is very difficult to mutually connect the connector and the terminal corresponding to the connector in a state where a plurality of connectors prepared on one side board and a plurality of terminals prepared on the other side board are disposed vertically by the two boards in a state where the two boards are disposed vertically, it takes a lot of work time and when a force is excessively applied, the pin of the connector is damaged, resulting in a failure in signal connection.

There has been a problem in that the work is delayed and the cost is high because it is necessary to replace the connector having the damaged pin upon the occurrence of such a failure.

In consideration of the above problem, in a structure of connecting the board and the board to each other by the RF connector, studied is a method for stably fastening the connector to the counterpart by rotating the interface of the connector even when there is a slight difference in position when being fastened to the counterpart, and particularly, the development of a coaxial connector capable of stable signal connection even while increasing an assembly tolerance between two boards is in a very urgent situation.

DISCLOSURE

Technical Problem

The present disclosure is intended to solve the above problem, and an object of the present disclosure is to provide a coaxial connector, which may increase an assembly tolerance between a first PCB and a second PCB.

In addition, another object of the present disclosure is to provide a coaxial connector, which may simplify components, thereby reducing manufacturing costs of a product.

In addition, still another object of the present disclosure is to provide a coaxial connector, which may improve a contact ratio of a contact portion for signal connection, thereby improving the quality of a product.

Technical Solution

An embodiment of a coaxial connector according to the present disclosure includes a fixing module which is connected to a first panel, and a contact module which is coupled movably to the fixing module, and provided to be contactable to a second panel facing the first panel, the contact module includes a contact body which is made of a conductive material, and has a hollow formed therein, a contact pin which is made of a conductive material, and disposed to penetrate the hollow of the contact body, and a contact insulator which is disposed in the hollow of the contact body to insulate the contact pin and the contact body by partitioning the contact pin and the contact body, and the contact module is configured so that the contact body, the contact pin, and the contact insulator are integrally coupled to each other movably with respect to the fixing module between the first panel and the second panel.

Here, the contact module may have the contact insulator subjected to an insert injection molding so that the contact pin is latched to and fixed to the contact insulator at the center of the hollow of the contact body.

In addition, the contact module may have the contact insulator subjected to the insert injection molding into the hollow of the contact body so that the contact pin is assembled by being inserted into and latched to the center of the contact insulator.

In addition, the center of the contact insulator may be formed with an insertion hole into which the contact pin is inserted, and the inner circumferential surface of the insertion hole may be formed with a stopper hook groove to which a stopper hook rib formed on the outer circumferential surface of the contact pin is latched.

In addition, the contact pin may be forcibly fitted into and coupled to the insertion hole.

In addition, the coaxial connector may further include an elastic member which has one end supported by the fixing module and has the other end supporting the end surface of the rim of the contact module to elastically support the contact module outward from the fixing module.

In addition, the elastic member may be a coil spring which is disposed to surround a part of the outer circumferential surface of the contact module.

In addition, the elastic member may have the other end supporting the end surface of the rim of the contact body.

In addition, the contact body may include a contact portion in which the contact pin and the contact insulator are disposed, and a coupling portion which extends from the contact portion toward the fixing module, and is latched to and coupled to the interior of the fixing module.

In addition, the coaxial connector may further include an elastic member which has one end supported by the fixing module, and has the other end supporting the end surface of the rim of the contact portion to elastically support the contact module outward from the fixing module.

In addition, the coupling portion may extend from a portion, which is spaced at a predetermined distance apart from the rim end of the contact portion, toward the fixing module so as to form the end surface of the rim of the contact portion supported by the other end of the elastic member.

In addition, the front end of the coupling portion may be forcibly fitted into and coupled to the interior of the fixing module.

In addition, the coupling portion may include a plurality of cutout portions which are cutout at a predetermined length in a moving direction of the contact module, and are spaced at a predetermined distance in the circumferential direction thereof.

In addition, the front end of the coupling portion may be coupled sliding-movably in a state of contacting the inner circumferential surface of the fixing module.

In addition, an air dielectric may be filled in an inner space between the fixing module and the coupling portion.

In addition, the fixing module may include a fixing body which is made of a conductive material, and have a hollow formed therein, a fixing pin which is made of a conductive material, and provided so that one end always contacts the contact pin, and the other end penetrates the hollow of the fixing body to contact the first panel, and a fixing insulator which is disposed in the hollow of the fixing body to insulate the fixing pin and the fixing body by partitioning the fixing pin and the fixing body.

In addition, the fixing module may have the fixing insulator subjected to the insert injection molding so that the fixing pin is latched to and fixed to the fixing insulator at the center of the hollow of the fixing body.

In addition, the fixing module may have the fixing insulator subjected to the insert injection molding into the hollow of the fixing body so that the fixing pin is assembled by being inserted into and latched to the center of the fixing insulator.

In addition, the center of the fixing insulator may be formed with an insertion hole into which the fixing pin is inserted, and the inner circumferential surface of the insertion hole may be formed with a stopper hook groove to which a stopper hook rib formed on the outer circumferential surface of the fixing pin is latched.

In addition, the fixing pin may be forcibly fitted into and coupled to the insertion hole.

In addition, the coaxial connector may further include an elastic member which elastically supports the contact module outward from the fixing module, and the fixing module may include a delivery portion in which the fixing pin and the fixing insulator are disposed, and a support portion which extends from the delivery portion toward the contact module, and supports the contact body so that a part of the contact body is accommodated.

In addition, the elastic member may be formed on the end of the rim of the support portion, may have one end supported by being accommodated in an elastic member support groove which is provided to be opened toward the contact module, and have the other end supported by the contact body.

In addition, the support portion may include a latching bush which extends from the delivery portion toward the contact module to be latched to the contact body while accommodating a part of the contact body when the contact module moves.

In addition, the end of the contact body may be forcibly fitted into and coupled to the inner surface of the latching bush.

In addition, the contact body may be moved in a state where the end accommodated inside the latching bush contacts the inner circumferential surface of the latching bush.

In addition, an air dielectric may be filled in an inner space between the contact module and the latching bush.

In addition, one end of the fixing pin may be formed with a contact accommodating groove portion in which a part of the contact pin is accommodated to be always contacted when the contact module moves.

In addition, the contact accommodating groove portion may include a plurality of elastic cutout portions which are cutout at a predetermine length in a moving direction of the contact module, and are spaced at a predetermined distance in the circumferential direction thereof.

In addition, the coaxial connector may further include a ground terminal which is made of a conductive material, provided on the contact body of the contact module, and grounded to be elastically supported by the second panel.

In addition, the ground terminal may include a fixing ring portion which is fixed to an installation groove portion formed to be recessed on the end of the rim of the contact body, and a plurality of elastic ground portions which are formed in plural from the inner circumferential end of the fixing ring portion in the circumferential direction, radially extend toward the center thereof, and extend to be inclined toward the second panel.

In addition, the contact module may further include an elastic support body which elastically supports the contact insulator toward the second panel.

In addition, the first panel and the second panel may be provided as a Printed Circuit Board (PCB).

Advantageous Effects

According to an embodiment of the coaxial connector according to the present disclosure, the contact module between the first panel and the second panel is provided to be stretched axially with respect to the fixing module, thereby increasing the assembly allowable tolerance to improve assemblability and workability.

In addition, by increasing the assembly allowable tolerance of the first panel and the second panel, it is possible to reduce the overall length of the coaxial connector assembled between the first panel and the second panel in design, and to reduce the separation distance between the first panel and the second panel in design, thereby slimly designing the product overall.

In addition, according to an embodiment of the coaxial connector according to the present disclosure, it is possible to integrally manufacture the coaxial connector without the separation between male and female and assemble the coaxial connector between the first PCB and the second PCB, thereby reducing the cost of the product.

In addition, according to an embodiment of the coaxial connector according to the present disclosure, it is possible to improve the contact ratio between the contact pin which is in charge of the signal connection of any one of the first PCB and the second PCB and the fixing pin which is in charge of the signal connection of the other one thereof, thereby improving the quality of the product.

DETAILED DESCRIPTION OF MAIN ELEMENTS

Figure 1:
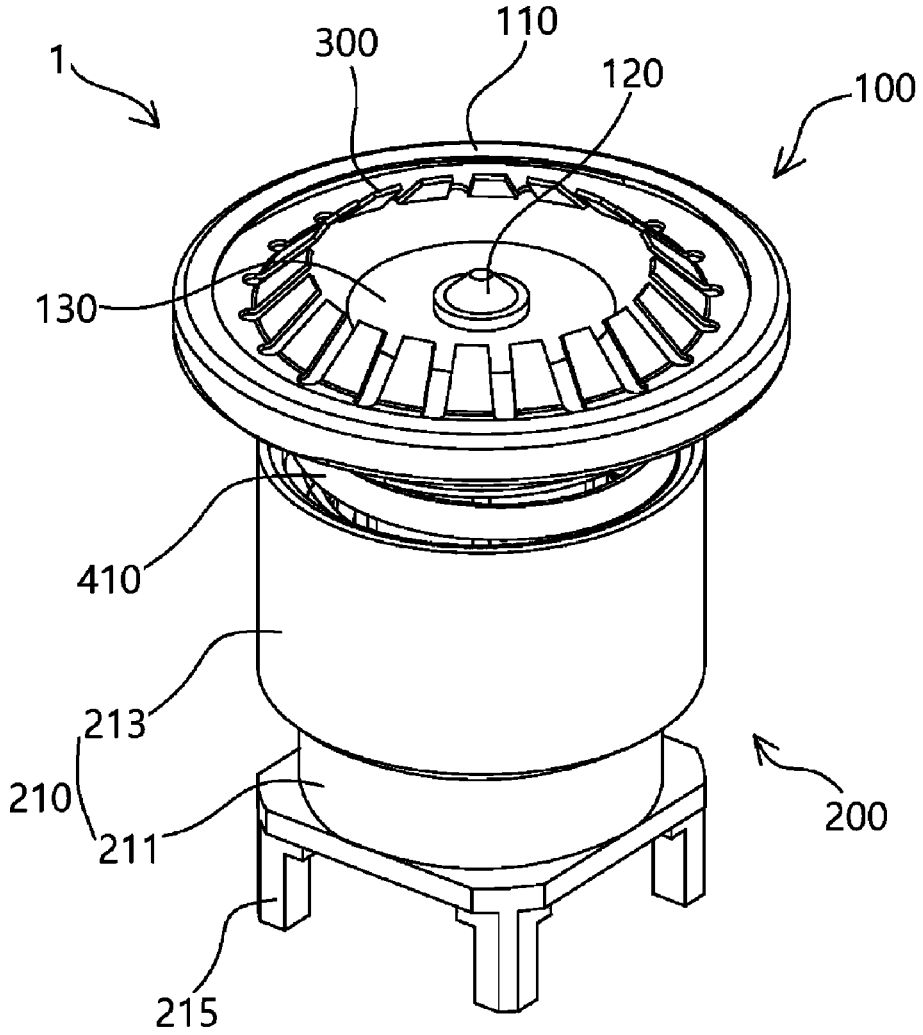
FIG. 1 is a perspective diagram illustrating an embodiment of a coaxial connector according to the present disclosure.

First PCB: P1
Second PCB: P2
1: coaxial connector
100: contact module
110: contact body
111, 113: contact portion
114: latching end
115: coupling portion
116: installation surface
117: latching groove
118: installation groove portion
119: cutout portion
120: contact pin
121: contact end
122: latching end
123: stopper hook groove
130: contact insulator
131: fixing portion block
133: shielding portion block
135: insertion hole
200: fixing module
210: fixing body
211: delivery portion
213: support portion
215: fixing leg
217: elastic member support groove
217A: latching bush
218: latching end
219: hook latching rib
220: fixing pin
221: solder portion
223: fitting portion
225: insertion limit portion
227: contact accommodating groove portion
229: elastic cutout portion
230: fixing insulator
232: stopper hook rib
235: insertion hole
239: stopper hook rib
300: ground terminal
310: fixing ring portion
320: elastic ground portion
410: elastic member
420: elastic support body

BEST MODE

Hereinafter, an embodiment of a coaxial connector according to the present disclosure will be described in detail with reference to the accompanying drawings.

Figure 2:
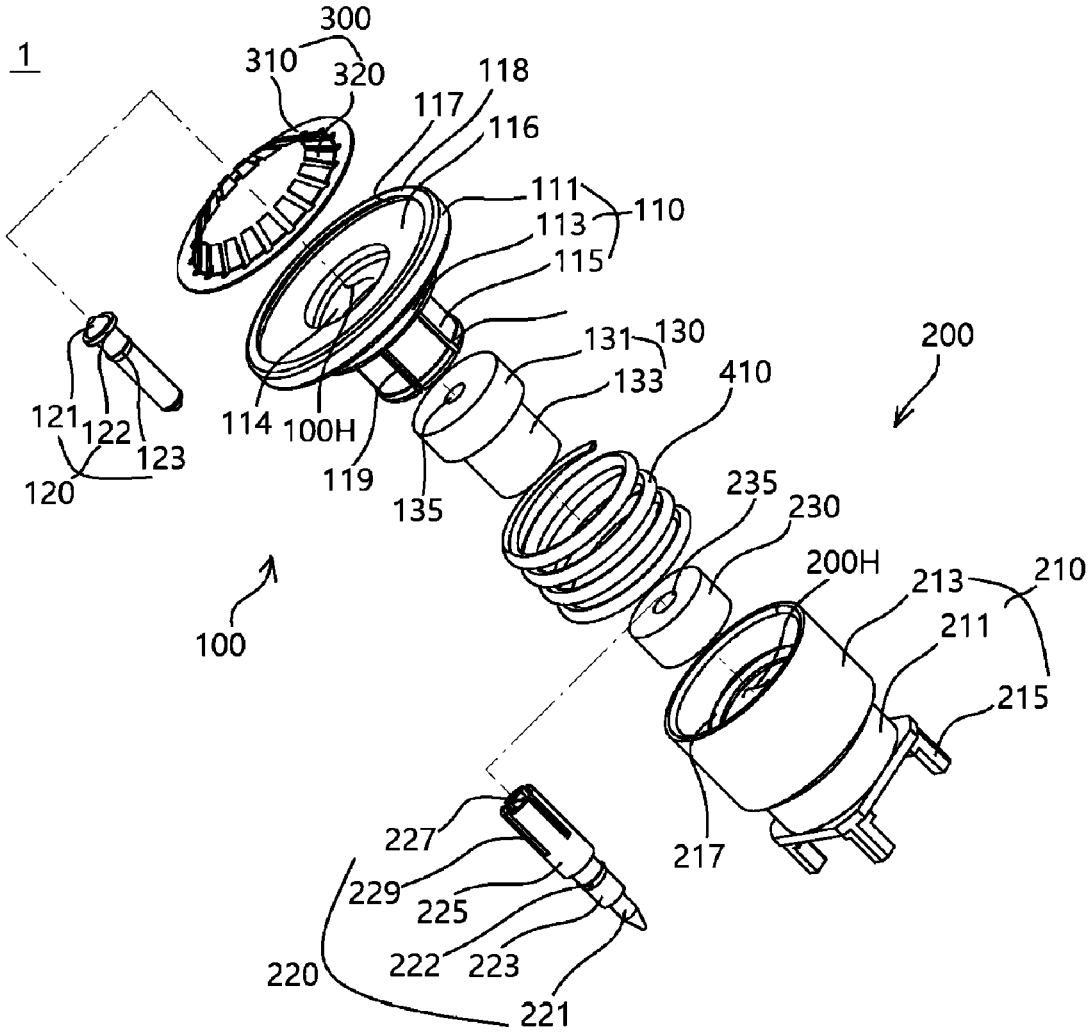
FIG. 2 is an exploded perspective diagram of FIG. 1.
Figure 3:
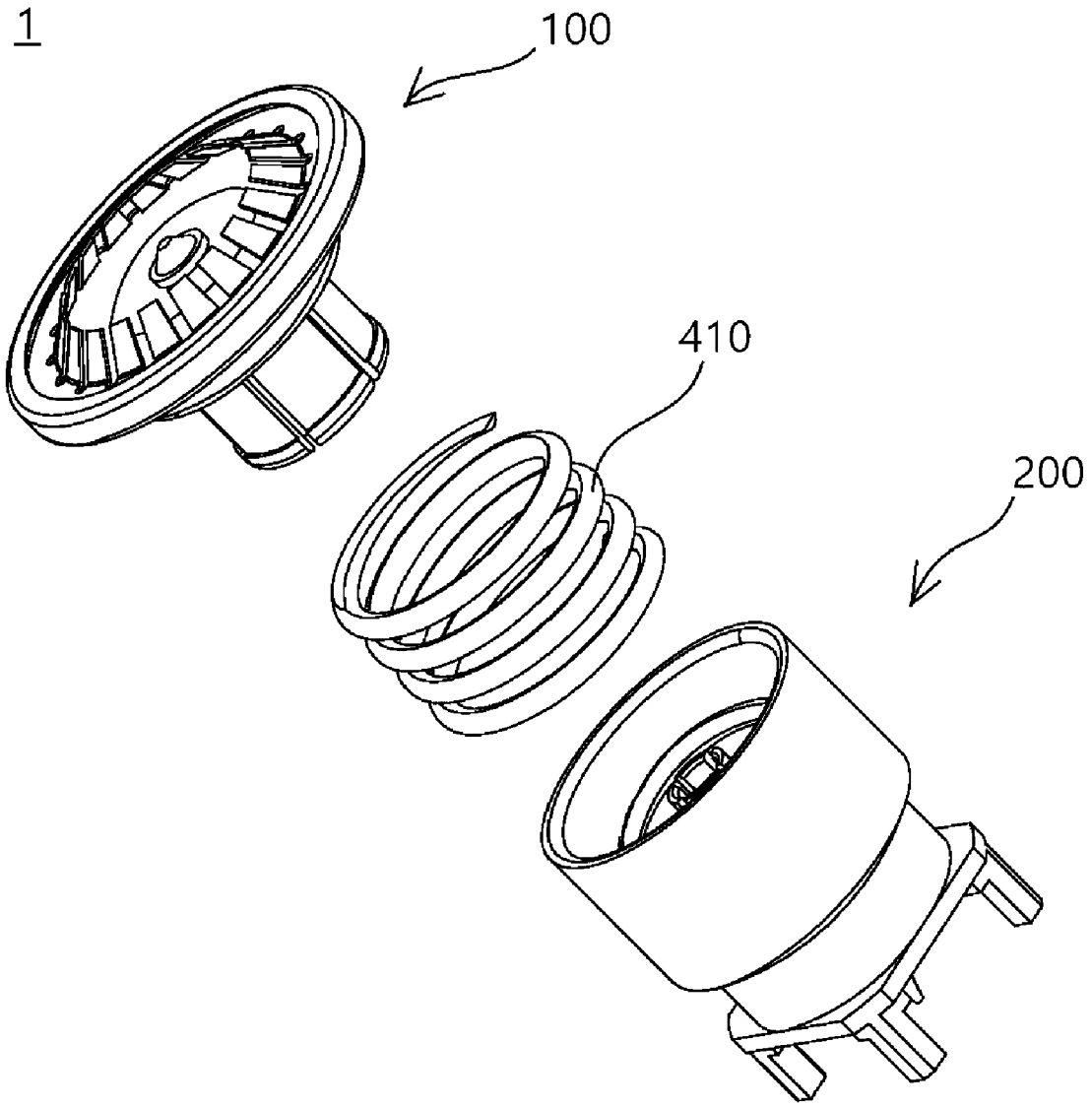
FIG. 3 is an exploded perspective diagram illustrating a state where a contact module and a fixing module among the components of FIG. 1 are separated.
Figure 4:
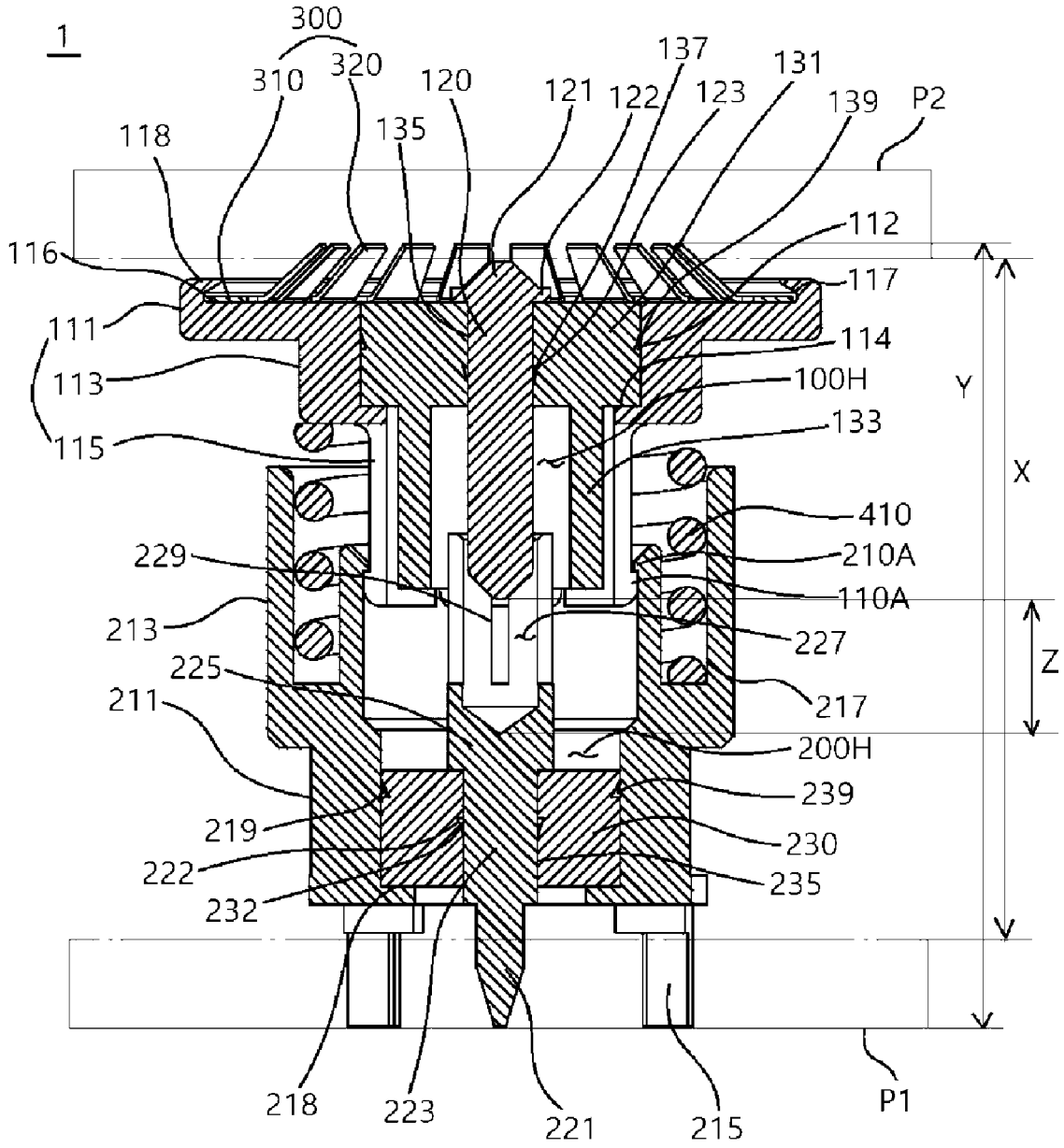
FIG. 4 is a cross-sectional diagram of FIG. 1.

FIG. 1 is a perspective diagram illustrating an embodiment of a coaxial connector according to the present disclosure, FIG. 2 is an exploded perspective diagram of FIG. 1, FIG. 3 is an exploded perspective diagram illustrating a state where a contact module and a fixing module among the components of FIG. 1 are separated, and FIG. 4 is a cross-sectional diagram of FIG. 1.

As illustrated in FIGS. 1 and 2, an embodiment of a coaxial connector 1 according to the present disclosure includes a fixing module 200 which is coupled to a first panel (P1), and a contact module 100 which is coupled movably to the fixing module 200, and provided to be contactable on a second panel (P2) facing the first panel (P1).

Here, the first panel (P1) and the second panel (P2) may be provided as a Printed Circuit Board which is provided with a general patterned contact circuit (not illustrated), but are not limited only to PCB. For example, it will be said that the first panel (P1) and the second panel (P2) will include all of the switch products manufactured in a method rather than a general PCB manufacturing method as a manufacturing method thereof. However, hereinafter, the first panel (P1) and the second panel (P2) will be described, for example, as being the first PCB (P1) and the second PCB (P2) with patterned contact circuits printed on facing surfaces, respectively.

In addition, while the fixing module 200 has been named in that the fixing module may be fixed to any one of the first PCB (P1) and the second PCB (P2) (in an embodiment of the present disclosure, the first PCB (P1) corresponds thereto), actually, the fixing module 200 is not required to be completely fixed to the first PCB (P1) by a solder method, and a connection configuration which may be supported between the first PCB (P1) and the second PCB (P2) is sufficient. Accordingly, in construing the claims of the coaxial connector 1 according to the present disclosure, it may not be limitedly construed by the name thereof.

The contact module 100 is coupled to the fixing module 200, and is movably coupled to the fixing module 200. More specifically, the contact module 100 is connected to one side of the fixing module 200 and moved with respect to the fixing module 200 so that a length of the coaxial connector 1 is entirely stretched.

Figure 5:
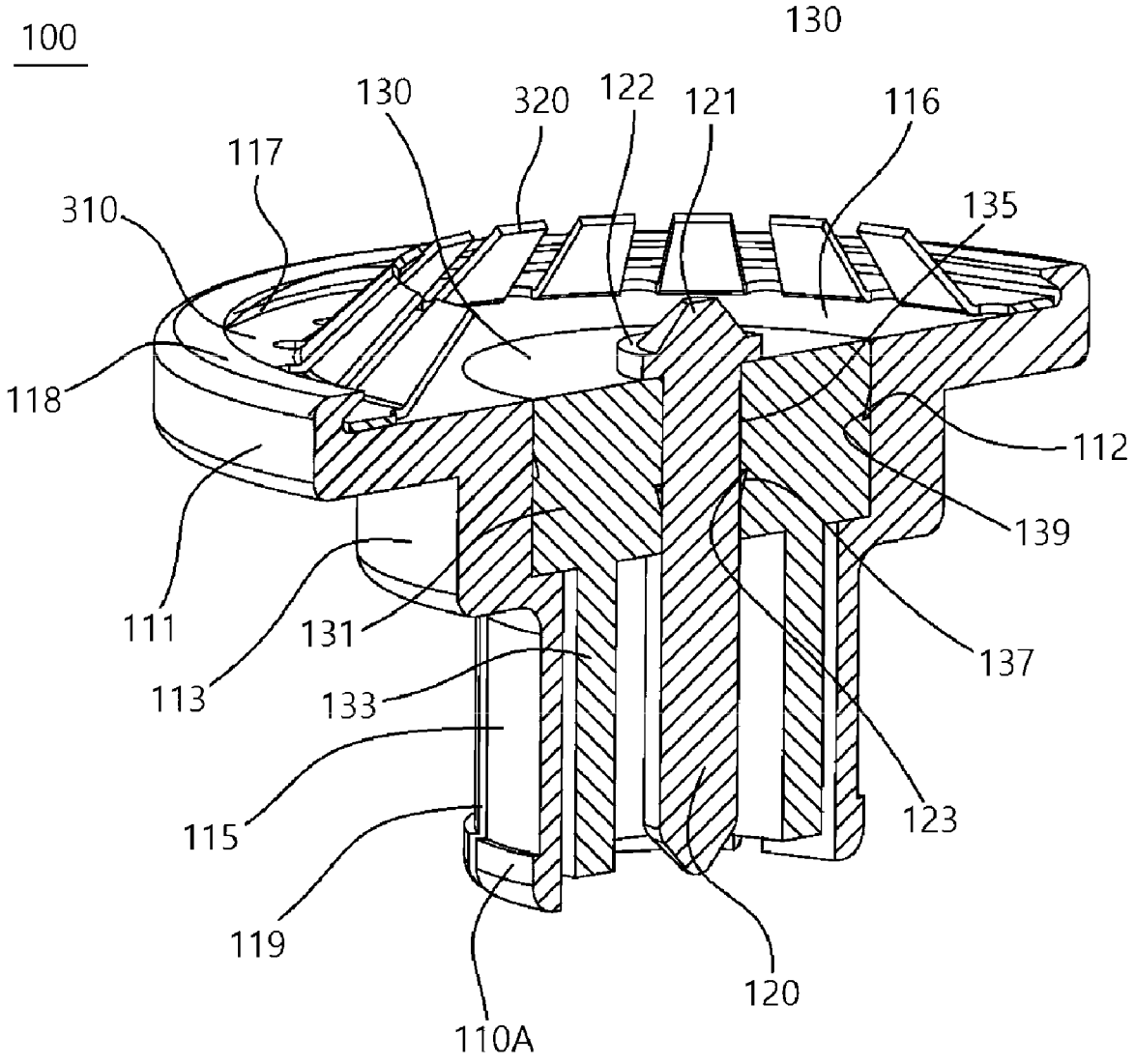
FIG. 5 is a cutout perspective diagram of the contact module.
Figure 6:
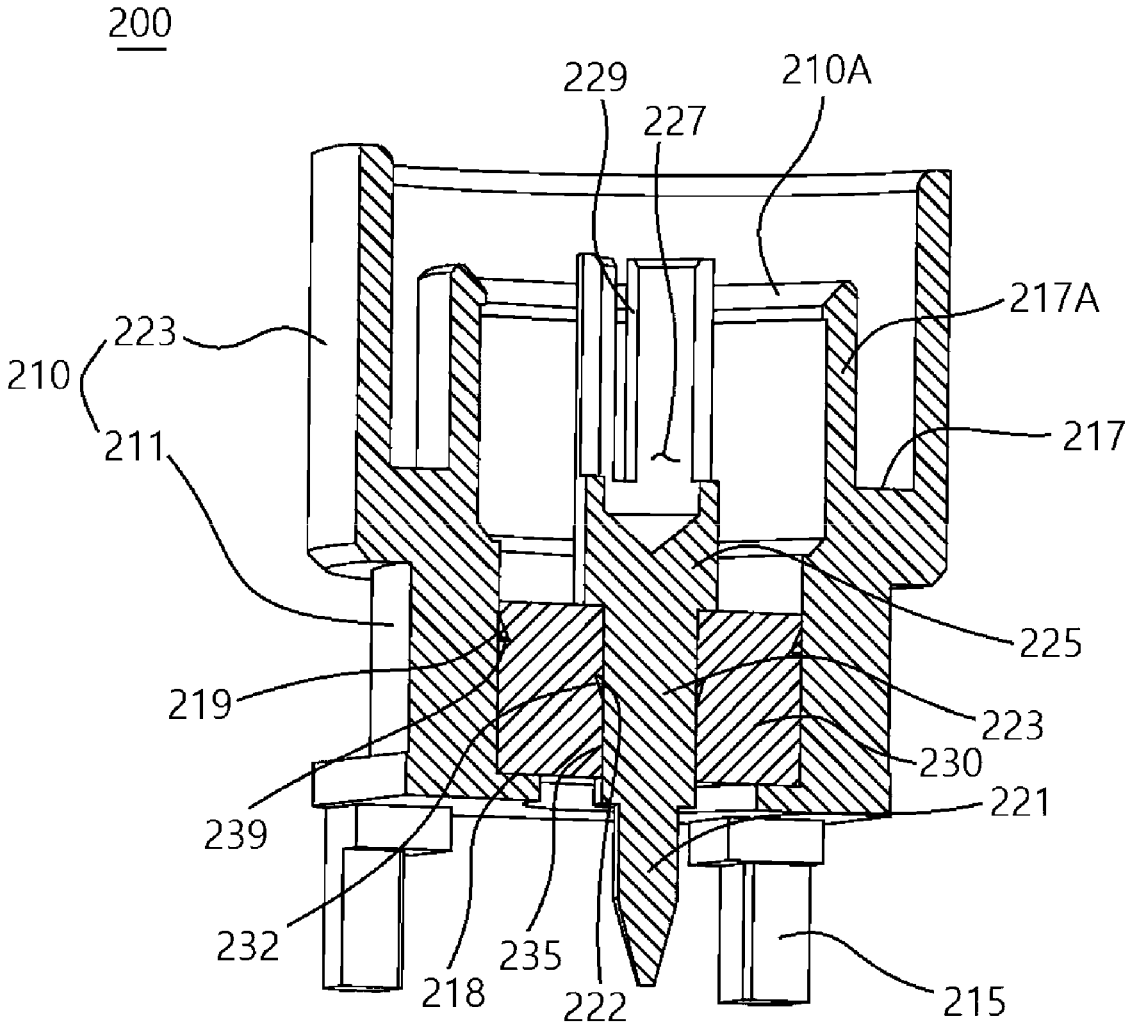
FIG. 6 is a cutout perspective diagram of the fixing module.
Figure 7:
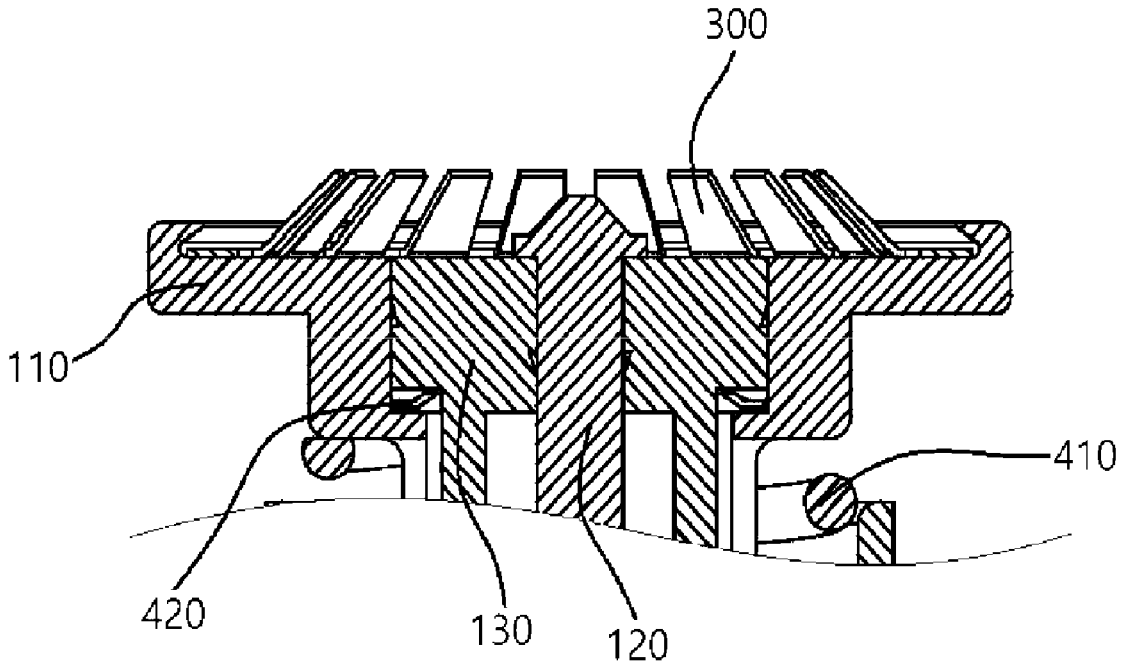
FIG. 7 is a cross-sectional diagram illustrating a state where an elastic support body, which supports a contact insulator among the components illustrated in FIG. 1, is assembled.

FIG. 5 is a cutout perspective diagram of the contact module 100, FIG. 6 is a cutout perspective diagram of the fixing module 200, and FIG. 7 is a cross-sectional diagram illustrating a state where an elastic support body 420, which supports a contact insulator 130 among the components illustrated in FIG. 1, is assembled.

As illustrated in FIGS. 3 and 5, the contact module 100 may include a contact body 110 which is made of a conductive material, and has a hollow 100H formed therein, a contact pin 120 which is made of a conductive material, and disposed to penetrate the hollow 100H of the contact body 110, and a contact insulator 130 which is disposed in the hollow 100H of the contact body 110 to insulate the contact pin 120 and the contact body 110 by partitioning the contact pin 120 and the contact body 110.

Here, the contact body 110 has the hollow 100H formed therein, and is provided in a cylindrical shape with one end and the other end, which are a delivery direction of the signal, opened, and may be formed so that the outer diameter of one end contacting the second PCB (P2) is larger than the outer diameter of the other end adjacent to the fixing module 200. Preferably, the inner diameter of the hollow 100H formed to penetrate the interior of the contact body 110 may also be formed so that one end contacting the second PCB (P2) is larger than the other end adjacent to the fixing module 200.

The outer diameter and the inner diameter of the contact body 110 may be formed to be stepped so that a change in the sizes thereof may be clearly identified externally.

As illustrated in FIGS. 3 and 5, the contact body 110 may be formed to have three different outer diameters. Hereinafter, for convenience of description, from a portion having the largest outer diameter to a portion having the smallest outer diameter will be sequentially referred to as a first outer diameter portion, a second outer diameter portion, and a third outer diameter portion.

In addition, as illustrated in FIGS. 3 and 5, the contact body 110 may be formed to have two different inner diameters. Likewise, for convenience of description, a portion having a relatively large inner diameter will be referred to as a first inner diameter portion, and a portion having a relatively small inner diameter will be referred to as a second inner diameter portion.

In addition, in an embodiment of the coaxial connector 1 according to the present disclosure, the first outer diameter portion and the second outer diameter portion of the contact body 110 are collectively referred to as contact portions 111, 113, a contact insulator 130 is fixed to the contact portions 111, 113, the third outer diameter portion of the contact body 110 is referred to as a coupling portion 115, the contact insulator 130 extends to the second inner diameter portion, and the coupling portion 115 is latched and coupled to the interior of the fixing module 200.

The first inner diameter portion is formed in the hollow 100H corresponding to ranges of the first outer diameter portion and the second outer diameter portion, and the second inner diameter portion extends from the first inner diameter portion to be formed in the hollow 100H corresponding to ranges of the second outer diameter portion and the third outer diameter portion.

One end of the contact body 110 formed by the first outer diameter portion is provided with an installation surface 116 on which a ground terminal 300 to be described later is installed in the form of a plane around the aforementioned first inner diameter portion. The end of the rim of the installation surface 116 may be formed with an installation groove portion 118 so that a latching groove 117 with the ground terminal 300 latched is formed.

Here, the contact pin 120 is formed to have the size which completely crosses the first inner diameter portion and the second inner diameter portion, and disposed in the center portion of the hollow 100H.

Meanwhile, the contact insulator 130 is disposed in the hollow 100H of the contact body 110 to insulate the contact pin 120 and the contact body 110 by physically partitioning the contact pin 120 and the contact body 110. This is to prevent a signal flowing through the contact pin 120 from being short-circuited by the contact body 110 because the contact body 110 and the contact pin 120 are made of conductive materials.

Here, the contact insulator 130 is a dielectric made of a strong plastic material, and serves to support the contact position of the contact pin 120 not to be changed. Particularly, the contact insulator 130 preferably adopts a high performance plastic material such as Polyetherimide (PEI) or Polybenzimidazole (PBI) in consideration of the maximum allowable temperature and the minimum allowable temperature considering the heat deflection temperature and the actual use environment, the dielectric constant which is a necessary condition of the dielectric itself, and the like.

The contact insulator 130 may include a fixing portion block 131 which is disposed in the first inner diameter portion and provided to be completely filled between the contact pin 120 and the contact body 110, and a shielding portion block 133 which extends from the fixing portion block 131 to be disposed in the second inner diameter portion and provided to extend to be spaced at a predetermined distance apart from the inner surface of the second inner diameter portion and the outer circumferential surface of the contact pin 120.

The contact insulator 130 has the fixing portion block 131 fixed to the first inner diameter portion of the contact portions 111, 113 of the contact body 110. More specifically, the inner circumferential surface of the first inner diameter portion of the contact portions 111, 113 is formed with a hook latching rib 112 which protrudes inward so that the fixing portion block 131 of the contact insulator 130 is latched in a direction opposite to the second inner diameter portion, and the outer circumferential surface of the fixing portion block 131 of the contact insulator 130 is formed with a hook latching groove 139 so that the hook latching rib 112 is accommodated to be latched to the outer circumferential surface of the fixing portion block 131.

The contact insulator 130 is fixed to the contact body 110 by an operation in which the contact insulator 130 is inserted from the outside of the first inner diameter portion of the contact portions 111, 113 into the first inner diameter portion.

Here, the outer diameter of the fixing portion block 131 of the contact insulator 130 is formed to have about the size corresponding to the inner diameter of the first inner diameter portion, and the fixing portion block 131 of the contact insulator 130 is forcibly fitted into and coupled to the inner circumferential surface by the hook latching rib 112 provided on the inner circumferential surface of the first inner diameter portion when being inserted into the first inner diameter portion.

At this time, the fixing portion block 131 of the contact insulator 130 may have the front end at the insertion direction side latched to a latching end 114 which is formed by the boundary between the first inner diameter portion and the second inner diameter portion, and at the same time, have the hook latching rib 112 and the hook latching groove 139 of the first inner diameter portion coupled to each other, thereby preventing the contact insulator 130 from being separated from the first inner diameter portion in a direction opposite to the second inner diameter portion.

The center of the fixing portion block 131 of the contact insulator 130 may be formed with an insertion hole 135 into which the contact pin 120 is penetrated and inserted. The contact pin 120 may be forcibly fitted into and coupled to the insertion hole 135. To this end, the inner diameter of the insertion hole 135 and the outer diameter of the contact pin 120 are preferably formed to have about the sizes at which the contact pin 120 may be forcibly fitted into the insertion hole 135 may be fitted forcibly.

The contact pin 120 is inserted into the insertion hole 135, and includes a contact end 121 which is formed to protrude at a predetermined length to the side provided with the second PCB (P2). Since the contact surface of the contact end 121 contacts a contact circuit patterned on the second PCB (P2) to transmit a signal, it is advantageous as the contact area is larger. However, since a portion of the patterned contact circuit of the second PCB (P2) may be designed in various forms, the contact surface of the contact end 121 is not necessarily formed in a plane.

In addition, the contact pin 120 may further include a latching end 122 which is provided so that the outer diameter thereof is increased along the circumference of the contact end 121, and formed to be latched to the outer circumference of the insertion hole 135. The latching end 122 serves to limit the insertion amount of the contact pin 120 into the insertion hole 135.

In addition, the outer circumferential surface of the contact pin 120 may be formed with a stopper hook rib 137 which is latched to the fixing portion block 131 to prevent the contact pin 120 from being separated after being inserted into the insertion hole 135 of the contact insulator 130. The inner circumferential surface of the insertion hole 135 of the fixing portion block 131 may be formed with a stopper hook groove 123 to which the stopper hook rib 137 of the contact pin 120 is latched.

With regard to the stopper hook rib 137 and the stopper hook groove 123, when the contact pin 120 is inserted into the insertion hole 135 of the fixing portion block 131 in a forcibly fitting method, the latching end 122 of the contact pin 120 is latched to the outer circumferential surface of the insertion hole 135 and at the same time, the stopper hook rib 137 and the stopper hook groove 123 are latched to and coupled to each other, thereby completing the robust assembly.

In an embodiment of the coaxial connector 1 according to the present disclosure, in a state where the fixing module 200 is connected to the first PCB (P1), when the contact module 100 composed of the assembly of the contact body 110, the contact pin 120, and the contact insulator 130 described above is assembled to contact the patterned contact circuit of the second PCB (P2), a signal connection line between the first PCB (P1) and the second PCB (P2) is configured. The signal connection line may be a signal transmission line which is configured from the first PCB (P1) to the second PCB (P2) via a fixing pin 220 to be described later of the fixing module 200 and the aforementioned contact pin 120, and may be a signal transmission line which is configured from the second PCB (P2) to the first PCB (P1) via the fixing module 200 including the aforementioned contact pin 120 and the fixing pin 220 to be described later.

Here, in an embodiment of the coaxial connector 1 according to the present disclosure, the contact body 110, the contact pin 120, and the contact insulator 130 among the components of the aforementioned contact module 100 are formed integrally to be assembled to the fixing module 200 by a singular process.

To this end, before the contact module 100 is assembled to the fixing module 200 by a singular process, the contact insulator 130 is forcibly fitted into, coupled to, and fixed to the contact body 110 serving as a housing, and then the contact pin 120 is forcibly fitted into and coupled to the contact insulator 130, thereby being configured as a single component.

However, in an embodiment of the present disclosure, the contact module 100 is not necessarily formed integrally in the aforementioned forcibly fitting method, and although not illustrated in the drawings, the contact module 100 may also be provided so that the contact insulator 130 is subjected to the insert injection molding so that the contact pin 120 is latched to and fixed to the contact insulator 130 at the center of the hollow 100H of the contact body 110.

Even in this case, it is natural that the first inner diameter portion of the contact body 110 is formed with the hook latching rib 112 in advance, and the outer circumferential surface of the contact pin 120 is formed with the stopper hook rib 137 in advance so that the contact pin is latched to the contact insulator 130 which is subjected to the insert injection molding.

At this time, the contact insulator 130 is not necessarily subjected to the insert injection molding together with the contact pin 120, and the contact insulator 130 may also be subjected to the insert injection molding into the hollow 100H of the contact body 110 so that the contact pin 120 is inserted into, latched to, and assembled to the insertion hole 135, which is the center of the contact insulator 130.

As described above, the contact body 110, the contact pin 120, and the contact insulator 130, which are the respective components of the contact module 100, are assembled and formed integrally before being coupled to the fixing module 200, thereby reducing the number of assembly processes.

In addition, the overall contact module 100 is movably coupled integrally with respect to the fixing module 200 between the first PCB (P1) and the second PCB (P2), thereby easily managing the assembly tolerance between the first PCB (P1) and the second PCB (P2). For example, the separation distance between the first PCB (P1) and the second PCB (P2) is fixed at a design value. At this time, if the fixing module 200 is not moved with respect to the contact module 100, the allowable assembly tolerance is very restricted for the stable contact of the coaxial connector 1. Here, an embodiment of the coaxial connector 1 according to the present disclosure may increase the assembly allowable tolerance between the first PCB (P1) and the second PCB (P2) by the level at which the contact module 100 is moved with respect to the fixing module 200 as described above.

Such an increase in the assembly allowable tolerance between the first PCB (P1) and the second PCB (P2) may substantially reduce the overall length of the coaxial connector 1 which is assembled between the first PCB (P1) and the second PCB (P2) in design, and also reduce the separation distance between the first PCB (P1) and the second PCB (P2) in design, thereby slimly designing the overall product.

Meanwhile, as illustrated in FIGS. 3 and 6, the fixing module 200 may include a fixing body 210 which is made of a conductive material, and has a hollow 200H formed therein, a fixing pin 220 which is made of a conductive material, and provided so that one end thereof always contacts the contact pin 120 of the contact module 100 described above, and the other end thereof penetrates the hollow 200H of the fixing body 210 to contact the first PCB (P1), and a fixing insulator 230 which is disposed in the hollow 200H of the fixing body 210 to insulate the fixing pin 220 and the fixing body 210 by partitioning the fixing pin 220 and the fixing body 210.

Here, the fixing body 210 may include a delivery portion 211 on which the fixing pin 220 and the fixing insulator 230 are disposed, and a support portion 213 which extends from the delivery portion 211 toward the contact module 100, and supports the contact body 110 so that a part of the contact body 110 is accommodated.

As in the contact body 110 of the contact module 100, the fixing body 210 also has the hollow 200H formed therein, is provided in a cylindrical shape with one end and the other end, which are a delivery direction of a signal, opened, and may be formed so that the outer diameter of one end contacting the first PCB (P1) is smaller than the outer diameter of the other end adjacent to the contact module 100. In addition, the inner diameter of the hollow 200H formed to penetrate the interior of the fixing body 210 may also be formed so that one end adjacent to the first PCB (P1) is smaller than the other end adjacent to the contact module 100.

Particularly, it is natural that each of the outer diameter and the inner diameter of the fixing body 210 may be formed to be stepped in the inner and outer portions so that a change in the sizes thereof is clearly identified externally.

One side surface on which the first PCB (P1) of the fixing body 210 is provided may be formed with a plurality of fixing legs 215 which is inserted into and connected to a PCB fixing hole (not numbered) previously prepared in the first PCB (P1). The plurality of fixing legs 215 may be inserted into and connected to the PCB fixing hole of the first PCB (P1) and then may be coupled by a solder method, and may also be forcibly fitted into and fixed to the PCB fixing hole simply.

As illustrated in FIGS. 3 and 6, the fixing body 210 may be formed to have two different outer diameters, and may also be formed to have two different inner diameters.

Hereinafter, for convenience of description, portions having relatively small outer diameter and inner diameters are referred to as a first outer diameter portion and a first inner diameter portion, and portions having relatively large outer diameter and inner diameters are referred to as a second outer diameter portion and a second inner diameter portion.

In addition, in the fixing module 200, portions formed by the first outer diameter portion and the first inner diameter portion of the fixing body 210 are collectively referred to as the delivery portion 211, the fixing insulator 230 is fixed to the delivery portion 211, portions formed by the second outer diameter portion and the second inner diameter portion of the fixing body 210 are collectively referred to as the support portion 213, and the second inner diameter portion of the support portion 213 may be formed to have the size at which a part of the aforementioned contact module 100 is accommodated.

More specifically, the delivery portion 211 of the fixing body 210 is formed to configure the first outer diameter portion and the first inner diameter portion, the fixing insulator 230 is disposed in the first inner diameter portion, and the center of the fixing insulator 230 is formed with the insertion hole 235 into which the fixing pin 220 is inserted. The fixing pin 220 may be inserted into, and coupled to the insertion hole 235 in a forcibly fitting manner from the second inner diameter portion side to the side having the first PCB (P1).

Here, after being fixed to the fixing insulator 230, the fixing pin 220 may be formed to have a length at which the end of the side having the contact module 100 is completely accommodated inside the second inner diameter portion and the end of the side having the first PCB (P1) is inserted into a solder hole (not numbered) prepared in the first PCB (P1) to be coupled by the solder.

The fixing insulator 230 is disposed in the hollow 200H (particularly, first inner diameter portion) of the fixing body 210 to insulate the fixing pin 220 and the fixing body 210 by physically partitioning the fixing pin 220 and the fixing body 210. This is to prevent a signal flowing through the fixing pin 220 from being short-circuited by the fixing body 210 because the fixing body 210 and the fixing pin 220 are made of conductive materials. The fixing insulator 230 is disposed in the first inner diameter portion and serves to completely insulate between the fixing pin 220 and the fixing body 210. Here, as in the aforementioned contact insulator 130, the fixing insulator 230 is made of an ultem material which is a strong plastic material, and serves to firmly support the fixing pin 220.

The outer circumferential surface of the fixing insulator 230 is provided with a hook latching groove 239 to be recessed inward, and is latched to and fixed to a hook latching rib 219 formed to protrude inward so as to latch the fixing insulator 230 to the inner circumferential surface of the first inner diameter portion, which forms the delivery portion 211 of the fixing body 210 in a direction opposite to the side having the first PCB (P1).

Here, the fixing insulator 230 is fixed to the fixing body 210 by the operation of being inserted into the first inner diameter portion from the second inner diameter portion side which forms the support portion 213.

That is, the outer diameter of the fixing insulator 230 is formed to have about the size corresponding to the inner diameter of the first inner diameter portion, and may be forcibly fitted and coupled by the hook latching rib 219 provided on the inner circumferential surface of the first inner diameter portion when the fixing insulator 230 is inserted into the first inner diameter portion.

At this time, the fixing insulator 230 may have the front end at the insertion direction side latched to a latching end 218, which is formed to be stepped to have a smaller inner diameter on the end adjacent to the first PCB (P1) side of the first inner diameter portion, and at the same time, have the hook latching rib 219 and the hook latching groove 239 of the first inner diameter portion coupled to each other, thereby preventing the fixing insulator 230 from being separated from the first inner diameter portion toward the second inner diameter portion.

The center of the fixing insulator 230 may be formed with the insertion hole 235 into which the fixing pin 220 is penetrated and inserted. The fixing pin 220 may be forcibly fitted into and coupled to the insertion hole 235. To this end, the inner diameter of the insertion hole 235 and the outer diameter of the fixing pin 220 are preferably formed to have about the sizes at which the fixing pin 220 may be forcibly fitted into the insertion hole 235.

The outer circumferential surface of the fixing pin 220 may be formed with a stopper hook rib 232 which is latched to the fixing insulator 230 to prevent the fixing pin 220 from being separated after being inserted into the insertion hole 235 of the fixing insulator 230. The inner circumferential surface of the insertion hole 235 of the fixing insulator 230 may be formed with a stopper hook groove 222 to which the stopper hook rib 232 of the fixing pin 220 is latched.

As illustrated in FIGS. 3 and 6, the fixing pin 220 may include a solder portion 221 which is inserted into the solder hole of the first PCB (P1), a fitting portion 223 which is accommodated inside the insertion hole 235 of the fixing insulator 230, and an insertion limit portion 225 which is formed to be larger in the outer diameter than the fitting portion 223 and latched to the outer surface of the insertion hole 235 of the fixing insulator 230.

Here, when the fixing pin 220 is inserted into the insertion hole 235 of the fixing insulator 230 in a forcibly fitting method, the insertion limit portion 225 of the fixing pin 220 is latched to the outer circumferential surface of the insertion hole 235 and at the same time, the stopper hook rib 232 and the stopper hook groove 222 are latched to and coupled to each other, thereby completing the robust assembly.

In an embodiment of the coaxial connector 1 according to the present disclosure, as in the aforementioned contact module 100, the fixing module 200 is also characterized that the fixing body 210, the fixing pin 220, and the fixing insulator 230 are formed integrally.

To this end, in the fixing module 200, the fixing insulator 230 is forcibly fitted into, coupled to, and fixed to the fixing body 210 serving as a housing, and then the fixing pin 220 is forcibly fitted into and coupled to the fixing insulator 230, thereby being configured as a single component.

However, in an embodiment of the present disclosure, the fixing module 200 is not necessarily formed integrally in the aforementioned forcibly fitting method, and although not illustrated in the drawings, the fixing module 200 may also be provided so that the fixing insulator 230 is subjected to the insert injection molding so that the fixing pin 220 is latched to and fixed to the fixing insulator 230 at the center of the hollow 200H of the fixing body 210.

Even in this case, it is natural that the first inner diameter portion of the fixing body 210 is formed with the hook latching rib 219 in advance, and the outer circumferential surface of the fixing pin 220 is formed with the stopper hook rib 232 in advance so that the fixing body 210 and the fixing pin 220 are latched to the fixing insulator 230 which is subjected to the insert injection molding.

At this time, the fixing insulator 230 is not necessarily subjected to the insert injection molding together with the fixing pin 220, and the fixing insulator 230 may also be subjected to the insert injection molding into the hollow 200H of the fixing body 210 so that the fixing pin 220 is assembled by being inserted into and latched to the insertion hole 235, which is the center of the fixing insulator 230.

Meanwhile, the second inner diameter portion of the fixing body 210 may be further formed with a latching bush 217A which extends from the end of the first inner diameter portion in a direction in which the contact module 100 is provided, and forms a space which is opened upward between the end of the first inner diameter portion and the inner surface of the second inner diameter portion (an elastic member support groove 217 in which one end of an elastic member 410 to be described later is supported). That is, the latching bush 217A may be formed to extend from the delivery portion 211 forming the first inner diameter portion of the fixing body 210 to the second inner diameter portion toward the contact module 100.

The latching bush 217A is provided substantially in a housing shape with the upper portion opened in the second inner diameter portion, and may be provided in a shape of surrounding the insertion limit portion 225 among the components of the fixing pin 220.

The latching bush 217A is coupled to be latched to the contact body 110 while accommodating a part of the contact body 110 of the contact module 100. To this end, the front end of the inner circumferential surface of the latching bush 217A may be formed so that a hook rib for module coupling 210A protrudes inward, and the front end of the coupling portion 115 of the contact body 110 may be formed so that a hook projection for module coupling 110A, which is latched to and fastened to the hook rib for module coupling 210A protrudes outward.

Here, the coupling portion 115 of the contact body 110 is preferably formed to have the size at which the coupling portion 115 is forcibly fitted into the latching bush 217A of the fixing body 210. That is, the size of the third outer diameter portion of the contact body 110 may be set as the size at which the coupling portion 115 is forcibly fitted into the latching bush 217A of the fixing body 210. At this time, the coupling portion 115 of the contact body 110 may include a plurality of cutout portions 119 which are cutout at a predetermined length in the moving direction of the contact module 100 to facilitate the forcibly fitting coupling to the latching bush 217A while being elastically deformed, and is space at a predetermined distance in the circumferential direction thereof.

Accordingly, when the coupling portion 115 of the contact body 110 is forcibly fitted into and coupled to the interior of the latching bush 217A, the end of the coupling portion 115 of the contact body 110 always contacts the inner circumferential surface of the latching bush 217A when the end of the coupling portion 115 of the contact body 110 is fitted into and coupled to the interior of the latching bush 217A while being easily elastically deformed and then the coupling force is eliminated, thereby always forming the sliding contact between the contact body 110 and the fixing body 210 upon the movement of the contact module 100.

Meanwhile, as illustrated in FIGS. 3 and 6, one end of the fixing pin 220 may be further formed with a contact accommodating groove portion 227 in which a part of the contact pin 120 is accommodated to be always contacted when the contact module 100 moves.

The contact accommodating groove portion 227 is formed so that a part of the insertion limit portion 225 of the fixing pin 220 is recessed in the moving direction of the contact module 100, and may be formed to have a shape corresponding to the shape of the end of the contact pin 120.

Here, the end of the contact pin 120 accommodated inside the contact accommodating groove portion 227 needs to be always contacted not only when the contact module 100 moves but also even after the coaxial connector 1 according to the present disclosure is assembled and fixed between the first PCB (P1) and the second PCB (P2). This is because when the end of the contact pin 120 accommodated inside the contact accommodating groove portion 227 is spaced, a signal deficiency may occur, resulting in a problem of degrading the quality of the product.

In an embodiment of the coaxial connector 1 according to the present disclosure, the contact accommodating groove portion 227 may include a plurality of elastic cutout portions 229 which are cutout in the moving direction of the contact module 100, and are spaced at a predetermined distance in the circumferential direction so that the contact rate with the end of the contact pin 120 accommodated inside the contact accommodating groove portion 227 is improved.

The plurality of elastic cutout portions 229 have the insertion limit portion 225, which configures the contact accommodating groove portion 227 and is formed to be cutout at a plurality of sites so that the elastic deformation is easily performed by the external force, such that the elastic deformation force may be continuously added toward the outer circumferential surface of the contact pin 120 when the end of the contact pin 120 is accommodated in the contact accommodating groove portion 227, thereby improving the contact rate.

Meanwhile, as illustrated in FIGS. 1 to 4, an embodiment of the coaxial connector 1 according to the present disclosure may further include a ground terminal 300 which is made of a conductive material, provided on the contact body 110 of the contact module 100, and grounded to be elastically supported by the second PCB (P2).

The ground terminal 300 may include a fixing ring portion 310 which is fixed to the installation groove portion 118 formed to be recessed at the end of the rim of the contact body 110, and a plurality of elastic ground portions 320 which are formed in plural at the inner circumferential end of the fixing ring portion 310 in the circumferential direction thereof, radially extend to the center thereof, and extend to be inclined toward the second PCB (P2).

Accordingly, in case of coupling the contact module 100 to the fixing module 200, and then moving and pressing one surface on which a contact circuit having a predetermined pattern of the second PCB (P2) is provided for the contact installation to the second PCB (P2), the elastic ground portion 320 of the ground terminal 300 for the ground is elastically in close contact with one surface of the second PCB (P2), thereby always keeping the ground.

The ground contact may configure a ground line which is delivered from the second PCB (P2) to the first PCB (P1) sequentially through the ground terminal 300, the contact body 110, and the fixing body 210, which are made of conductive materials.

In an embodiment of the coaxial connector 1 according to the present disclosure, an air dielectric may be filled in the inner space between the fixing module 200 and the coupling portion 115 of the contact body 110 among the components of the fixing module 200. Likewise, the air dielectric may be filled in the inner space between the contact module 100 and the latching bush 217A corresponding to the support portion 213 of the fixing module 200. Here, the air dielectric serves to assist the insulation function in the air together with the contact insulator 130 and the fixing insulator 230.

Meanwhile, as illustrated in FIGS. 1 to 4, an embodiment of the coaxial connector 1 according to the present disclosure may further include the elastic member 410 which has one end supported by the fixing module 200 and has the other end supporting the end surface of the rim of the contact module 100 to elastically support the contact module 100 outward from the fixing module 200.

Here, the elastic member 410 may be configured as a coil spring which is disposed to surround a part of the outer circumferential surface of the contact module 100. However, the elastic member 410 is not necessarily limited thereto, and all means which may elastically support the contact module 100 in the moving direction with respect to the fixing module 200 will be considered to be included in the scope of the elastic member 410 according to the present disclosure.

More specifically, one end of the elastic member 410 is supported by the elastic member support groove 217 formed in the fixing module 200. The other end of the elastic member 410 is supported by the end surface of the rim formed by the difference between the outer diameters of the second outer diameter portion and the first outer diameter portion of the contact body 110 among the components of the contact module 100.

The elastic member 410 provided as the coil spring is installed to elastically support the contact module 100 outward from the fixing module 200 in a compressed state when the contact module 100 is installed to the fixing module 200. At this time, the elastic member 410 is preferably compressed and installed so that the contact module 100 is elastically supported at a setting distance or more in the moving direction with respect to the fixing module 200. Here, the setting distance is preferably set to the maximum, and the increase in the setting distance may derive the advantage of increasing the narrow assembly tolerance between the first PCB (P1) and the second PCB (P2) to the maximum.

For example, as illustrated in FIG. 4, when the assembly setting separation distance between the first PCB (P1) and the second PCB (P2) is X and the allowable assembly tolerance exists, it is possible to increase the assembly tolerance allowable range to the maximum by the level at which at least a range of Z is included in a range of the X when the overall length before the coaxial connector 1 according to the present disclosure is assembled is Y larger than the X, and a movable distance of the contact module 100 with respect to the fixing module 200 is the Z.

As described above, when an embodiment of the coaxial connector 1 according to the present disclosure is interposed between the first PCB (P1) and the second PCB (P2), the contact module 100 may be moved to be stretched at a setting distance or more with respect to the fixing module 200 to design the separation distance between the first PCB (P1) and the second PCB (P2) to be substantially closer to each other, thereby slimly designing the overall product.

In addition, according to an embodiment of the coaxial connector 1 according to the present disclosure, there is no need to provide a separate elastic member between the contact pin 120 and the fixing pin 220, which substantially configure the signal contact, thereby reducing the cost, and simplifying the components of the product in design.

This is based on the fact that the contact insulator 130, which simultaneously supports and couples the contact body 110 and the contact pin 120 configured as individual components, is made of a strong material. That is, when the material of the contact insulator 130 is weak, the separate elastic member is not used, and when the elastic body 410 is used to elastically support only the contact body 110, there is a concern that a gap occurs between the respective components by continuously applying an elastic force from the elastic member 410, which is provided in a compressed state as described above. Such a phenomenon may also be equally applied to the coupling relationship between the respective components (fixing body 210, fixing pin 220, and fixing insulator 230) of the fixing module 200.

Accordingly, in order to secure the aforementioned advantages in an embodiment of the coaxial connector 1 according to the present disclosure, it is efficient that the contact insulator 130 and the fixing insulator 230 are made of strong materials as described above.

However, particularly, in case of the contact insulator 130, there is a concern that the contact insulator 130 will be deformed faster than the fixing insulator 230 as the elastic force provided from the elastic member 410 to be described later is repeatedly applied. When the contact insulator 130 is deformed, it may cause a minute change in the contact position of the contact pin 120, such that in an embodiment of the coaxial connector 1 according to the present disclosure, it is preferable that the contact module 100 may further include the elastic support body 420 which may elastically support the contact insulator 130 toward the second PCB (P2), as illustrated in FIG. 7.

That is, the elastic support body 420 is provided at the latching end 114 formed by the boundary between the first inner diameter portion and the second inner diameter portion, as illustrated in FIG. 7, and serves to elastically support the fixing portion block 131 of the contact insulator 130.

As describe above, the embodiments of the coaxial connector according to the present disclosure have been described in detail with reference to the accompanying drawings. However, it is natural that the embodiments of the present disclosure are not necessarily limited to the aforementioned embodiments, and various modifications and the practice in the equivalent scope may be made by those skilled in the art to which the present disclosure pertains. Accordingly, the true scope of the present disclosure will be defined by the claims to be described later.

INDUSTRIAL APPLICABILITY

According to the present disclosure, the contact module may be provided to be stretched axially with respect to the fixing module between the first panel and the second panel to increase the assembly allowable tolerance, thereby manufacturing the coaxial connector having improved assemblability and workability.

What is claimed is:

1. A coaxial connector comprising:

a fixing module connected to a first panel; and a contact module coupled to a second panel facing the first panel, wherein the contact module is configured to slidably move with respect to the fixing module between the first panel and the second panel;

wherein the contact module comprises a contact pin, and wherein the fixing module comprises:

a cylinder-shaped fixing body with a first hollow space therein;

a fixing pin which penetrates the first hollow space and is provided so that one end thereof contacts the contact pin of the contact module; and a fixing insulator disposed in the first hollow space between the fixing body and the fixing pin to partition the fixing body from the fixing pin, wherein the fixing pin comprises a first cavity at its top end to accommodate at least a part of the contact pin.

2. The coaxial connector of claim 1, wherein the fixing body includes a delivery portion on which the fixing pin and the fixing insulator are disposed, and a support portion which extends from the delivery portion toward the contact module.

3. The coaxial connector of claim 1, wherein the fixing body and the fixing pin are made of conductive materials, respectively.

4. The coaxial connector of claim 1, wherein the contact module comprises:

a contact body which is made of a conductive material, and has a second hollow space formed therein; and a contact insulator which is disposed in the second hollow space of the contact body to insulate the contact pin and the contact body by partitioning the contact pin and the contact body, wherein the contact pin is made of a conductive material, and disposed to penetrate the second hollow space of the contact body.

5. The coaxial connector of claim 1, further comprising:

an elastic member which has one end supported by the fixing module and has another end supporting an end surface of a rim of the contact module to elastically support the contact module outward from the fixing module.

6. The coaxial connector of claim 1, wherein the fixing body has two different outer diameters, and two different inner diameters.

7. The coaxial connector of claim 1, wherein the contact pin is a cylindrical bar-shaped, and wherein a bottom end of the contact pin is configured to be slidably inserted into the first cavity.

8. The coaxial connector of claim 1, wherein the top end of the fixing pin first cavity comprises a plurality of cutout portions which are cut in a moving direction of the contact module, and are spaced at a predetermined distance in a circumferential direction.

9. A coaxial connector comprising:

a fixing module connected to a first panel; and a contact module coupled to a second panel facing the first panel, wherein the contact module is configured to slidably move with respect to the fixing module between the first panel and the second panel;

wherein the fixing module comprises:

a cylinder-shaped fixing body with a first hollow space therein;

a fixing pin which penetrates the first hollow space and is provided so that one end thereof contacts the contact pin of the contact module; and a fixing insulator disposed in the first hollow space between the fixing body and the fixing pin to partition the fixing body from the fixing pin, wherein the contact module comprises:

a contact pin;

a contact body which is made of a conductive material, and has a second hollow space formed therein; and a contact insulator which is disposed in the second hollow space of the contact body to insulate the contact pin and the contact body by partitioning the contact pin and the contact body, wherein the contact body comprises a plurality of cutout portions which are cut in a moving direction of the contact module, and are spaced at a predetermined distance in a circumferential direction.

10. The coaxial connector of claim 9, wherein the fixing body includes a delivery portion on which the fixing pin and the fixing insulator are disposed, and a support portion which extends from the delivery portion toward the contact module.

11. The coaxial connector of claim 9, wherein the fixing body and the fixing pin are made of conductive materials, respectively.

12. The coaxial connector of claim 9, further comprising:

an elastic member which has one end supported by the fixing module and has another end supporting an end surface of a rim of the contact module to elastically support the contact module outward from the fixing module.

* * * * *